US010829842B2

(12) United States Patent
Matsui et al.

(10) Patent No.: US 10,829,842 B2
(45) **Date of Patent: *Nov. 10, 2020**

(54) ROLLED STEEL BAR OR ROLLED WIRE ROD FOR COLD-FORGED COMPONENT

(71) Applicant: NIPPON STEEL CORPORATION, Tokyo (JP)

(72) Inventors: Naoki Matsui, Kisarazu (JP); Yutaka Neishi, Osaka (JP); Tetsushi Chida, Nishinomiya (JP); Akihisa Obata, Tokyo (JP); Shoji Hori, Hokkaido (JP); Keisuke Chiba, Toyota (JP)

(73) Assignee: NIPPON STEEL CORPORATION, Tokyo (JP)

( * ) Notice: Subject to any disclaimer, the term of this patent is extended or adjusted under 35 U.S.C. 154(b) by 135 days.

This patent is subject to a terminal disclaimer.

(21) Appl. No.: 15/523,808

(22) PCT Filed: Nov. 13, 2015

(86) PCT No.: PCT/JP2015/081988
§ 371 (c)(1),
(2) Date: May 2, 2017

(87) PCT Pub. No.: WO2016/080308
PCT Pub. Date: May 26, 2016

(65) Prior Publication Data

US 2017/0314107 A1 Nov. 2, 2017

(30) Foreign Application Priority Data

Nov. 18, 2014 (JP) ..... 2014-233971

(51) Int. Cl.
*C22C 38/54* (2006.01)
*C22C 38/32* (2006.01)
(Continued)

(52) U.S. Cl.
CPC ..... *C22C 38/54* (2013.01); *B21B 1/16* (2013.01); *C21D 6/004* (2013.01); *C21D 6/005* (2013.01);
(Continued)

(58) Field of Classification Search
None
See application file for complete search history.

(56) References Cited

U.S. PATENT DOCUMENTS 6,261,388 B1 7/2001 Kubota et al.
6,488,787 B1 12/2002 Ochi et al.
(Continued)

FOREIGN PATENT DOCUMENTS

CA 2 868 394 A1 10/2013
CA 2 931 047 A1 6/2015
(Continued)

OTHER PUBLICATIONS

Aalco Metals Limited internet publication, archived Nov. 3, 2011, as evidenced by the wayback machine (Year: 2011).*
(Continued)

*Primary Examiner* — Colleen P Dunn
*Assistant Examiner* — Michael J Kachmarik
(74) *Attorney, Agent, or Firm* — Birch. Stewart, Kolasch & Birch, LLP

(57) ABSTRACT

In a rolled steel bar or rolled wire rod for a cold-forged component having a predetermined chemical composition, Y1 represented by Y1=[Mn]×[Cr] and Y2 represented by Y2=0.134×(D/25.4−(0.50×√[C])/(0.50×√[C]) satisfy Y1>Y2, the tensile strength is 750 MPa or less, an internal structure is a ferrite-pearlite structure, and the ferrite fraction in the internal structure is 40% or greater.

5 Claims, 2 Drawing Sheets

(51) Int. Cl.

| | |
|---|---|
| ***B21B 1/16*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/24*** | (2006.01) |
| ***C22C 38/28*** | (2006.01) |
| ***C22C 38/50*** | (2006.01) |
| ***C21D 8/06*** | (2006.01) |
| ***C21D 6/00*** | (2006.01) |
| ***C21D 9/52*** | (2006.01) |
| *C21D 1/25* | (2006.01) |
| *C21D 1/18* | (2006.01) |
| *C22C 38/42* | (2006.01) |

(52) U.S. Cl.

CPC ..... *C21D 6/008* (2013.01); *C21D 8/06* (2013.01); *C21D 8/065* (2013.01); *C21D 9/525* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/24* (2013.01); *C22C 38/28* (2013.01); *C22C 38/32* (2013.01); *C21D 1/18* (2013.01); *C21D 1/25* (2013.01); *C21D 2211/005* (2013.01); *C22C 38/42* (2013.01); *C22C 38/50* (2013.01)

(56) References Cited

U.S. PATENT DOCUMENTS

| | | | | |
|---|---|---|---|---|
| 6,551,419 | B2 * | 4/2003 | Kanisawa | C21D 8/06 148/320 |
| 6,602,359 | B1 * | 8/2003 | Ochi | C21D 8/06 148/330 |
| 2007/0101789 | A1 | 5/2007 | Kondo et al. | |
| 2008/0156403 | A1 | 7/2008 | Masuda et al. | |
| 2017/0219000 | A1 * | 8/2017 | Matsumoto | C22C 38/48 |

FOREIGN PATENT DOCUMENTS

| | | | |
|---|---|---|---|
| CN | 1316018 | A | 10/2001 |
| CN | 1950532 | A | 4/2007 |
| CN | 101365819 | A | 2/2009 |
| CN | 102741441 | A | 10/2012 |
| CN | 103124801 | A | 5/2013 |
| CN | 103147201 | A | 6/2013 |
| EP | 1 045 044 | A1 | 10/2000 |
| EP | 1 178 126 | A1 | 2/2002 |
| JP | 2001-11575 | A | 1/2001 |
| JP | 2002-146480 | A | 5/2002 |
| JP | 2002-294401 | A | 10/2002 |
| JP | 3443285 | B2 | 9/2003 |
| JP | 2005-133152 | A | 5/2005 |
| JP | 4057930 | B2 | 3/2008 |
| JP | 2008-255398 | A | 10/2008 |
| JP | 2009-052062 | A | 3/2009 |
| JP | 2011-1599 | A | 1/2011 |
| JP | 2012-136730 | A | 7/2012 |
| JP | 2013-227602 | A | 11/2013 |
| JP | 2013-234349 | A | 11/2013 |
| KR | 10-2002-0088425 | A | 11/2002 |
| KR | 10-2007-0068511 | A | 7/2007 |
| WO | WO 01/48258 | A1 | 7/2001 |
| WO | WO 2007/074986 | A1 | 7/2007 |

OTHER PUBLICATIONS

Stainless Steel: Alloying in Elements Stainless Steel, Aalco Metals Limited internet publication, archived Nov. 3, 2011 (Year: 2011).*

International Search Report, issued in PCT/JP2015/081988, dated Jan. 19, 2016.

Taiwanese Office Action for Application No. 104137703, dated Oct. 6, 2016.

Written Opinion of the International Searching Authority, issued in PCT/JP2015/081988, dated Jan. 19, 2016.

The Extended European Search Report dated Mar. 23, 2018, issued in the counterpart European Patent Application No. 15860856.2.

Chinese Office Action and Search Report for counterpart Application No. 201580062057.7, dated Apr. 2, 2018, with an English translation.

Korean Office Action dated Aug. 6, 2018 issued in counterpart Korean Patent Application No. 10-2017-7012701.

Canadian Office Action for Canadian Application No. 2,966,479, dated May 28, 2018.

Chinese Office Action and Search Report for Chinese Application No. 201580062025.7, dated Feb. 5, 2018, with English translation.

Extended European Search Report for European Application No. 15860759.8, dated Apr. 4, 2018.

International Search Report (Form PCT/ISA/210) for International Application No. PCT/JP2015/082007, dated Jan. 19, 2016, with English translation.

Korean Notice of Allowance for Korean Application No. 10-2017-7012700, dated Jan. 7, 2019, with English translation.

Taiwanese Office Action and Search Report for Taiwanese Application No. 104137561, dated Jul. 4, 2016, with English translation.

U.S. Office Action for U.S. Appl. No. 15/526,808, dated Mar. 26, 2019.

Written Opinion of the International Searching Authority(PCT/ISA/237) for International Application No. PCT/JP2015/082007, dated Jan. 19, 2016.

U.S. Office Action dated Feb. 6, 2020, for U.S. Appl. No. 15/526,808.

* cited by examiner

ROLLED STEEL BAR OR ROLLED WIRE ROD FOR COLD-FORGED COMPONENT

TECHNICAL FIELD OF THE INVENTION

The present invention relates to a rolled steel bar or rolled wire rod that is suitable as a material of a cold-forged component and is excellent in cold forgeability. Particularly, the present invention relates to a rolled steel bar or rolled wire rod that is suitable as a material of a high-strength cold-forged component and is excellent in cold forgeability and in which the HRC hardness is 34 or greater after quenching and tempering.

Priority is claimed on Japanese Patent Application No. 2014-233971, filed on Nov. 18, 2014, the content of which is incorporated herein by reference.

RELATED ART

Cold forging is good for the surface texture and dimensional accuracy of components after forging. Components manufactured by cold forging are manufactured at lower cost than components manufactured by hot forging, and the yield ratio thereof is high. Accordingly, cold forging is widely applied to manufacture of components for various industrial machines including vehicles, such as gears, shafts, and bolts, or building structures.

In recent years, downsizing and weight reduction have proceeded in components for a mechanical structure used in vehicles, industrial machines, and the like, and an increase in size has proceeded in building structures. From such a background, components manufactured by cold forging are required to have a further increase in strength.

For these cold-forged components, a carbon steel for a mechanical structure specified in JIS G 4051, an alloy steel for a mechanical structure specified in JIS G 4053, and the like have been used. These steels, in general, are adjusted so as to have a predetermined strength or hardness by repeatedly performing a step including spheroidizing annealing and drawing or cold drawing of the steel which is hot product rolled into a steel bar shape or a wire rod shape, and by being formed into a component shape by cold forging and performing a heat treatment such as quenching and tempering.

The above-described steel for a mechanical structure has a relatively high carbon content of approximately 0.20% to 0.40%, and can be used as a high-strength component through a thermal refining treatment. Meanwhile, as for the above-described steel for a mechanical structure, the strength of a steel bar or wire rod that is a rolled steel that is used as a forging material is increased. Therefore, in a case where the steel is not softened by adding the cold drawing and the subsequent spheroidizing annealing step in the course of manufacturing, problems are generated during manufacturing, such as wear or cracking of the die easily occurring during cold forging for component formation, and component cracking.

Particularly, in recent years, there has been a tendency that components have a more complicated shape with an increased strength. The more complicated the component shape, the higher the possibility of the occurrence of cracking. Thus, in order to further soften the steel in which a high strength is obtained by quenching and tempering, before cold forging, measures are employed such as increasing the time of the spheroidizing annealing treatment or repeating the cold drawing step and the spheroidizing annealing step more than once.

However, these measures include a lot of costs such as personnel cost and equipment cost, and a large energy loss occurs. Accordingly, a steel that can be produced even in a case where the step is omitted or the time of the step is reduced is required.

Based on such a background, in order to omit the spheroidizing annealing treatment or reduce the time of the spheroidizing annealing treatment, a proposal has been made about a boron steel or the like produced in such a way that the strength of a rolled steel that is used as a forging material is reduced by reducing contents of alloy elements such as C, Cr, and Mn, and then a reduction in the hardenability caused by reducing the alloy elements is compensated by adding boron.

For example, Patent Document 1 discloses a hot-rolled steel for cold forging having an excellent grain coarsening resistance and excellent cold forgeability, and a method of manufacturing the hot-rolled steel for cold forging. Specifically, Patent Document 1 discloses a hot-rolled steel for cold forging having an excellent grain coarsening resistance and excellent cold forgeability in which 0.10% to 0.60% of C, 0.50% or less of Si, 0.30% to 2.00% of Mn, 0.025% or less of P, 0.025% or less of S, 0.25% or less of Cr, 0.0003% to 0.0050% of B, 0.0050% or less of N, and 0.020% to 0.100% of Ti are contained, and TiC or Ti(CN) having a diameter of 0.2 μm or less is contained at 20 pieces/100 $\mu m^2$ or greater in matrix of the steel, and a method of manufacturing the hot-rolled steel for cold forging.

Patent Document 2 discloses a steel for a mechanical structure for cold working, and a method of manufacturing the steel for a mechanical structure for cold working. Specifically, a steel for a mechanical structure for cold working that contains C, Si, Mn, P, S, Al, N, and Cr, and in which a metallographic structure has pearlite and pro-eutectoid ferrite, a total area fraction of the pearlite and pro-eutectoid ferrite to entire structure is 90% or greater, the relationship between an area fraction A of the pro-eutectoid ferrite and Ae represented by $Ae=(0.8-Ceq)\times 96.75$ (where $Ceq=[C]+0.1\times[Si]+0.06\times[Mn]+0.11\times[Cr]$ ([(element name)] means the amount (mass %) of each element)) is $A>Ae$, and the average grain size of ferrite in the pro-eutectoid ferrite and pearlite is 15 to 25 μm, and a method of manufacturing the same. In addition, it is disclosed that in the steel for a mechanical structure for cold working of Patent Document 2, sufficient softening can be realized by performing a normal spheroidizing treatment.

According to the technology disclosed in Patent Document 1, the hardness of the rolled steel can be reduced. Therefore, cold forging can be performed at low cost, and a grain coarsening resistance during quenching heating can be provided. However, in the steel of Patent Document 1, the Cr content of the steel is low, and thus the hardenability is low and there is a limit on increasing the strength of the component.

The steel for a mechanical structure for cold working disclosed in Patent Document 2 can be softened by performing a normal spheroidizing annealing treatment and can be applied to a high-strength component. However, the balance between the amounts of the chemical compositions of the steel is not optimized, and the ferrite fraction of the structure of the rolled steel is substantially small. Therefore, there is a problem in that in a case where the steel as-product-rolled or in which spheroidizing annealing treatment in a short period of time is performed, is used when cold forging is performed on the component, cracking occurs and the component cannot be manufactured at low cost.

PRIOR ART DOCUMENT

Patent Document

[Patent Document 1] Japanese Patent (Granted) Publication No. 3443285

[Patent Document 2] Japanese Unexamined Patent Application, First Publication No. 2013-227602

DISCLOSURE OF THE INVENTION

Problems to be Solved by the Invention

The present invention is made in view of the current situation, and an object thereof is to provide a rolled steel for a high-strength cold-forged component, which has a steel bar shape or a wire rod shape and which has excellent hardenability and cold forgeability. Here, excellent hardenability means that HRC hardness in a center portion is 34 or greater after performing quenching and tempering. Excellent cold forgeability means that the occurrence of cracking is effectively suppressed during cold forging even in a case where a spheroidizing annealing treatment is omitted or the time of the spheroidizing annealing treatment is reduced, before cold forging.

Means for Solving the Problem

The inventors have conducted various examinations in order to solve the above-described problems, and as a result, found the following knowledge.

(a) In a case where cold forgeability is secured so that component formation is possible even if a spheroidizing annealing treatment is omitted or the time of the spheroidizing annealing treatment is reduced, the tensile strength of the steel (rolled steel bar or rolled wire rod) as-product-rolled is required to be 750 MPa or less. In addition, the internal structure excluding a surface layer portion in which a decarburized layer may be generated is a ferrite-pearlite structure, and the ferrite fraction thereof is required to be greater than 40%.

(b) In order to secure a high component strength by quenching and tempering, the C content is required to be increased to increase quenched hardness (hardness after quenching), and alloy elements such as Mn and Cr are required to be contained to increase hardenability. That is, sufficient quenched hardness and hardenability necessary for the sufficient quenched hardness are required to be secured for use in a high-strength cold-forged component.

(c) In order to improve cold forgeability and secure hardness after quenching by an improvement of hardenability, it is necessary to control the internal structure in sufficient consideration of the balance between amounts of elements such as C, Si, Mn, and Cr.

The present invention is completed based on the above-described knowledge, and the gist thereof is as follows.

(1) A rolled steel bar or rolled wire rod for a cold-forged component according to an aspect of the present invention that has a chemical composition consisting of, in mass %: C: 0.24% to 0.36%; Si: less than 0.40%; Mn: 0.20% to 0.45%; S: less than 0.020%; P: less than 0.020%; Cr: 0.70% to 1.45%; Al: 0.005% to 0.060%; Ti: greater than 0.020% to 0.060%; B: 0.0003% to 0.0040%; N: 0.0020% to 0.0080%; Cu: 0% to 0.50%; Ni: 0% to 0.30%; Mo: 0% to 0.050%; V: 0% to 0.050%; Zr: 0% to 0.050%; Ca: 0% to 0.0050%; and Mg: 0% to 0.0050% with the remainder of Fe and impurities, in which Y1 and Y2 represented by the following Formulas <1> and <2>, satisfy a relationship represented by the following Formula <3>, a tensile strength is 750 MPa or less, an internal structure is a ferrite-pearlite structure, and a ferrite fraction is 40% or greater in the internal structure.

$$Y1=[Mn]\times[Cr] \quad \text{Formula <1>,}$$

$$Y2=0.134\times(D/25.4-(0.50\times\sqrt{[C]}))/(0.50\times\sqrt{[C]}) \quad \text{Formula <2>, and}$$

$$Y1>Y2 \quad \text{Formula <3>,}$$

where [C], [Mn], and [Cr] in the formulas represent respective amounts of elements in mass %, and D represents a diameter of the rolled steel bar or rolled wire rod in the unit of mm.

(2) In the rolled steel bar or rolled wire rod for a cold-forged component according to (1), the chemical composition may contain, in mass %, one or more selected from the group consisting of Cu: 0.03% to 0.50%, Ni: 0.01% to 0.30%, Mo: 0.005% to 0.050%, and V: 0.005% to 0.050%.

(3) In the rolled steel bar or rolled wire rod for a cold-forged component according to (1) or (2), the chemical composition may contain, in mass %, one or more selected from the group consisting of Zr: 0.003% to 0.050%, Ca: 0.0005% to 0.0050%, and Mg: 0.0005% to 0.0050%.

The "impurities" in the remainder of "Fe and impurities" are components unintentionally contained in the steel, and refer to materials mixed from ore as a raw material, scrap, a manufacturing environment, or the like in the industrial iron and steel manufacturing.

The rolled steel bar or rolled wire rod refers to a rolled steel with a steel bar shape or a wire rod shape as-hot-product-rolled. Hereinafter, in this specification of the present invention, the "rolled steel bar or rolled wire rod" may be collectively expressed as a "rolled bar and wire rod" or a "rolled steel". The hot product rolling may be expressed as "hot rolling".

Effects of the Invention

A rolled bar and wire rod (rolled steel bar or rolled wire rod) for a cold-forged component according to the aspect of the present invention has a tensile strength of 750 MPa or lower, and an internal metallographic structure thereof is a ferrite-pearlite structure having a ferrite fraction of 40% or greater. In addition, the rolled bar and wire rod has excellent cold forgeability, and hardenability since the amount of elements are controlled. Therefore, using the rolled bar and wire rod of the present invention as a material, a component can be formed by cold forging even in a case where a spheroidizing annealing treatment is omitted or the time of the spheroidizing annealing treatment is reduced, and a high-strength cold-forged component having an HRC hardness of 34 or greater can be obtained through quenching and tempering.

EMBODIMENTS OF THE INVENTION

Figure 1:
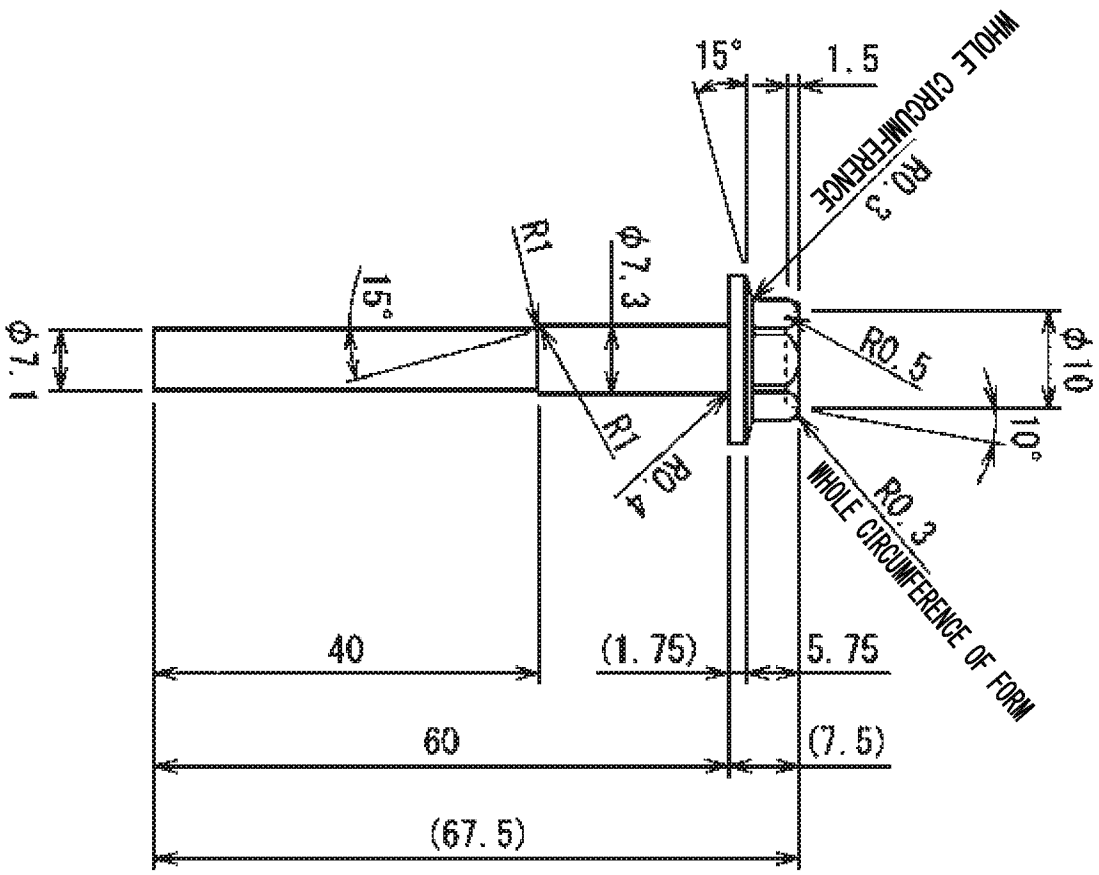
FIG. 1 is a diagram showing a shape of a bolt formed by forging in examples.

Hereinafter, a rolled steel bar or rolled wire rod for a cold-forged component according to an embodiment of the present invention (may be referred to as a rolled bar and wire rod according to this embodiment) will be described in detail. In the following description, the symbol "%" related to each element content means "mass %".

(A) Chemical Composition (Chemical Elements)

C: 0.24% to 0.36%

C is an element that increases hardenability of a steel to contribute to a strength improvement. In order to obtain this effect, the C content is controlled to be 0.24% or greater. In a case of further increasing quenched hardness of a cold-forged component, the C content is preferably controlled to be 0.26% or greater. In a case where the C content is greater than 0.36%, the cold forgeability is reduced. Accordingly, the C content is controlled to be 0.36% or less. In a case of further increasing the cold forgeability, the C content is preferably controlled to be 0.33% or less.

Si: Less than 0.40%

In order to reduce the tensile strength of a rolled steel after hot rolling (as-rolled), the Si content is preferably as low as possible. Accordingly, the Si content may be 0%. Meanwhile, since Si strengthens ferrite by solid solution strengthening, Si may be contained in order to obtain an effect of increasing the tempered hardness of a cold-forged component. However, since the cold forgeability is significantly reduced in a case where the Si content is 0.40% or greater, it is necessary to control the Si content to be less than 0.40% even in a case where Si is contained. From the viewpoint of cold forgeability, the Si content is preferably less than 0.30%, and more preferably less than 0.20%. The Si content is even more preferably 0.10% or less in consideration of the tensile strength of a rolled steel.

Mn: 0.20% to 0.45%

Mn is an element that increases hardenability of a steel, and in order to obtain this effect, the Mn content is controlled to be 0.20% or greater. It is preferable that Mn content is 0.25% or greater in order to further increase the hardenability. In a case where the Mn content is greater than 0.45%, a ferrite transformation start temperature is lowered during cooling after finish rolling, and thus the ferrite fraction is reduced and bainite is generated. As a result, the cold forgeability of the steel is reduced. Therefore, the Mn content is controlled to be 0.45% or less. In a case of improving the cold forgeability, the Mn content is preferably 0.42% or less, more preferably 0.40% or less, and even more preferably 0.35% or less.

S: Less than 0.020%

S is contained as impurities. S is an element that reduces cold forgeability, and the S content is preferably as low as possible. Particularly, in a case where the S content is 0.020% or greater, MnS has an elongated coarse form, and the cold forgeability is significantly reduced. Accordingly, the S content is limited to be less than 0.020%. The S content is preferably less than 0.010%.

P: Less Than 0.020%

P is contained as impurities. P is an element that reduces cold forgeability and is segregated in the grain boundary in heating to an austenite temperature range to cause cracking during quenching. Accordingly, the P content is preferably low. Particularly, in a case where the P content is 0.020% or greater, the cold forgeability is significantly reduced or cracking significantly occurs. Thus, the P content is less than 0.020%, and preferably less than 0.010%.

Cr: 0.70% to 1.45%

Cr is an element that increases hardenability of a steel as in a case of Mn. In order to obtain this effect, the Cr content is controlled to be 0.70% or greater. In order to stably obtain high hardenability, the Cr content is preferably 0.80% or greater, and more preferably 0.90% or greater. In a case where the Cr content is greater than 1.45%, the hardenability increases. However, a ferrite transformation start temperature is lowered during cooling after finish rolling, and thus the ferrite fraction is reduced and bainite is generated. As a result, the cold forgeability of the steel is reduced. Therefore, the Cr content is controlled to be 1.45% or less. In order to further increase the cold forgeability, the Cr content is preferably 1.30% or less, and more preferably 1.20% or less.

Al: 0.005% to 0.060%

Al is an element having a deoxidizing action. In addition, Al is an element that acts to form AlN by combining with N, refine austenite grains during hot rolling and suppress the generation of bainite by a pinning effect of AlN. In order to obtain these effects, the Al content is controlled to be 0.005% or greater. In a case of more securely suppressing the generation of bainite, the Al content is preferably 0.015% or greater, and more preferably 0.020% or greater. In a case where the Al content is greater than 0.060%, the effects of Al are saturated. In addition, coarse AlN is generated and the cold forgeability is thus reduced. Therefore, the Al content is controlled to be 0.060% or less. From the viewpoint of increasing the cold forgeability, the Al content is preferably 0.050% or less, and more preferably 0.045% or less.

Ti: Greater than 0.020% and 0.060% or Less

Ti is an element that forms a carbide, a nitride, or a carbonitride by combining with N or C, and has an effect of refining austenite grains during hot rolling by a pinning effect. The refining of austenite grains suppresses the generation of bainite in the course of cooling after finish rolling, and contributes to an increase in the ferrite fraction. In addition, Ti also acts to increase an effect of improving hardenability by B since Ti fixes, as TiN, N solid-dissolved in a steel, and thus suppresses the generation of BN. In order to obtain these effects, the Ti content is controlled to be greater than 0.020%. The Ti content is preferably 0.030% or greater, and more preferably greater than 0.035%. In a case where the Ti content is greater than 0.060%, fine Ti carbides or Ti carbonitrides are precipitated in a large amount during finish rolling, the ferrite is strengthened, and thus the tensile strength excessively increases. Therefore, the Ti content is controlled to be 0.060% or less. The Ti content is preferably 0.050% or less, and more preferably 0.045% or less.

B: 0.0003% to 0.0040%

B is an element effective for increasing hardenability even in a case where it is contained in a minute amount. In order to obtain this effect, the B content is controlled to be 0.0003% or greater. In a case of further increasing the hardenability, the B content is preferably 0.0005% or greater, and more preferably 0.0010% or greater. In a case where the B content is greater than 0.0040%, the hardenability improving effect is saturated, and the cold forgeability is reduced. In a case of further improving the cold forgeability, the B content is preferably 0.0030% or less, and more preferably 0.0025% or less.

N: 0.0020% to 0.0080%

N forms a nitride or a carbonitride by combining with Al, or Ti, and has an effect of refining of austenite grains in hot rolling. In order to obtain the effect, the N content is controlled to be 0.0020% or greater, and preferably 0.0030% or greater. In a case where the N content is too high, the effect of refining of austenite grains is saturated, and N combines with B and forms a nitride, thereby weakening the hardenability improving effect of B. Thus, the N content is controlled to be 0.0080% or less. In order to stably improve the hardenability, the N content is preferably less than 0.0070%, and more preferably 0.0060% or less.

Furthermore, in the bar according to this embodiment, it is also necessary to control the balance between the amounts of elements in addition to the actual amounts thereof. Specifically, Y1 represented by the following Formula <1> and Y2 represented by the following Formula <2> satisfy the relationship represented by Formula <3>.

$$Y1=[Mn]\times[Cr] \quad \text{Formula <1>}$$

$$Y2=0.134\times(D/25.4-(0.50\times\sqrt{[C]}))/(0.50\times\sqrt{[C]}) \quad \text{Formula <2>}$$

$$Y1>Y2 \quad \text{Formula <3>}$$

In the formulas, [C], [Mn], and [Cr] represent the respective amounts thereof in mass %, and D represents the diameter (mm) of the rolled bar and wire rod.

In a case of Y1>Y2, hardenability such that HRC hardness is 34 or greater in a center portion after a thermal refining treatment, is obtained by general quenching and tempering (for example, after heating in a temperature range of 880° C. to 900° C., quenching is performed by oil cooling, and tempering is performed at 400° C. to 600° C.).

Formulas <1> to <3> will be described.

As described above, Y1 is a value represented as a product of the masses (mass %) of Mn and Cr contained in the steel, and is a parameter of hardenability required for a rolled bar and wire rod for a high-strength cold-forged component.

Y2 is a parameter representing the relationship between D and [C] having an influence on the fraction of the martensite structure obtained, in a case where a rolled bar and wire rod having a diameter of D (mm) is heated to a temperature equal to or higher than an Ac3 point and quenched by oil cooling, at a position of D/2 (mm) from the surface that is a center portion of the rolled bar and wire rod. The cooling rate in the quenching by oil cooling varies depending on the diameter D of the rolled bar and wire rod, and in general, the cooling rate is approximately 10 to 40° C./sec.

The Ac3 point can be calculated from a known calculation formula, for example, Ac3=912.0−230.5×C+31.6×Si−20.4×Mn−39.8×Cu−18.1×Ni−14.8×Cr+16.8×Mo based on the chemical composition. Otherwise, the Ac3 point can be experimentally estimated from a change of an expansion ratio of the steel measured during temperature rise by heating.

After the thermal refining treatment by quenching and tempering, in order to obtain HRC hardness of 34 or greater in the center portion, it is necessary to control the quenched hardness before the tempering in the center portion (D/2 portion) of the rolled bar and wire rod to be 45 or greater in terms of HRC hardness. In addition, in order to control the quenched hardness to be 45 or greater in terms of HRC hardness, the C content, the Mn content, and the Cr content having a large influence on the quenched hardness are required to be adjusted.

In a case where the structure is martensite, the hardness thereof is almost determined by the C content, and in a case where the C content is in the range of the rolled bar and wire rod according to this embodiment, the hardness becomes 45 or greater in terms of HRC hardness. Therefore, in order to secure quenched hardness of 45 or greater in terms of HRC hardness, the structure after quenching may be controlled to be martensite in a major part (90% or greater in terms of a structure fraction).

As a result of the examination of the inventors, it has been found that 90% or greater of martensite is obtained after quenching in the center portion of the rolled bar and wire rod by controlling each of the Mn content and the Cr content to be a predetermined value or greater. Specifically, in a case where Y1 represented as a product of the contents of Mn and Cr and which increases the hardenability, is larger than the parameter Y2 representing the relationship between D and [C] having an influence on the fraction of the martensite structure obtained in the center portion of the rolled bar and wire rod, the structure of the center portion of the rolled bar and wire rod after quenching includes 90% or greater of martensite. Accordingly, in the rolled bar and wire rod according to this embodiment, Y1>Y2 is satisfied. In a case of Y1<Y2, an incompletely quenched structure such as bainite or ferrite is generated during quenching, and thus 90% or greater of martensite cannot be secured. In this case, the strength and the hydrogen embrittlement resistance are reduced.

Figure 2:
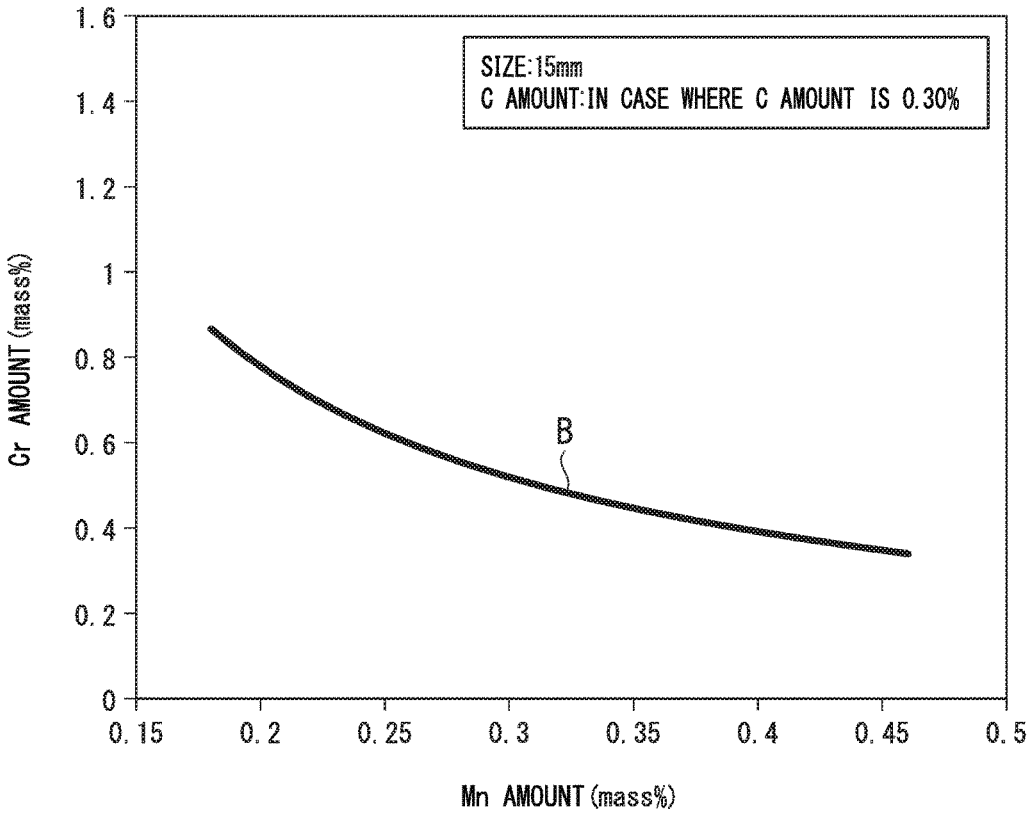
FIG. 2 is a diagram showing the relationship between: a Cr content and a Mn content; and hardenability.

FIG. 2 is a diagram showing the relationship between: a Cr content and a Mn content; and hardenability in a case where the diameter of a rolled bar and wire rod is 15 mm and a C content is 0.30%. In FIG. 2, in a case where the Mn content and the Cr content are above a border line B, Y1>Y2 is satisfied, and martensite occupies 90% or greater of the structure of the center portion of the rolled bar and wire rod after quenching.

As a specific standard of hardenability, in a steel hardenability test method (one end quenching method) of JIS G 0561, a so-called Jominy test, Hardness J 7 mm at a position separated from a quenched end by at least 7 mm may be 45 or greater in terms of HRC hardness.

Since the hardness of the rolled bar and wire rod after quenching also depends on the diameter D of the rolled bar and wire rod, the diameter D of the rolled bar and wire rod is preferably small from the viewpoint of hardenability. In a case where the rolled bar and wire rod is applied to a high-strength cold-forged component, the rolled bar and wire rod preferably has a diameter of approximately 6 to 35 mm, and more preferably 8 to 16 mm.

The rolled bar and wire rod according to this embodiment basically contains the above-described chemical compositions with the remainder of Fe and impurities. However, if necessary, at least one or more selected from Cu, Ni, Mo, V, Zr, Ca, and Mg may be contained in place of a part of Fe of the remainder. Since these elements are not necessarily required to be contained, the lower limits thereof are 0%. Here, the "impurities" are components unintentionally contained in the steel, and refer to materials mixed from ore as a raw material, scrap, a manufacturing environment, or the like in the industrial iron and steel manufacturing.

Hereinafter, actions and effects of arbitrary elements Cu, Ni, Mo, V, Zr, Ca, and Mg, and preferable contents thereof in a case where the elements are contained will be described.

Cu: 0.50% or Less

Cu is an element that increases hardenability, and may be contained. In order to stably obtain this effect, the Cu content is preferably 0.03% or greater, and more preferably 0.05% or greater. In a case where the Cu content is greater than 0.50%, the hardenability excessively increases, and bainite is generated after finish rolling. Thus, the cold forgeability is reduced. Accordingly, even in a case where Cu is contained, the Cu content is controlled to be 0.50% or less. The Cu content in a case where Cu is contained from the viewpoint of improving the cold forgeability is preferably 0.30% or less, and more preferably 0.20% or less.

Ni: 0.30% or Less

Ni is an element that increases hardenability, and may be contained. In order to stably obtain this effect, the Ni content is preferably 0.01% or greater, and more preferably 0.03% or greater. In a case where the Ni content is greater than 0.30%, the effect of Ni is saturated. In addition, the hardenability excessively increases, and bainite is generated after finish rolling. Thus, the cold forgeability is reduced. Accordingly, even in a case where Ni is contained, the Ni content is controlled to be 0.30% or less. The Ni content in a case where Ni is contained from the viewpoint of improving the cold forgeability is preferably 0.20% or less, and more preferably 0.10% or less.

Mo: 0.050% or Less

Mo is an element that strengthens a steel by solid solution strengthening, and significantly improves hardenability of a steel. Mo may be contained in order to obtain this effect. In order to stably obtain this effect, the Mo content is preferably 0.005% or greater. In a case where the Mo content is greater than 0.050%, bainite or martensite is generated after finish rolling, and the cold forgeability is reduced. Accordingly, even in a case where Mo is contained, the Mo content is controlled to be 0.050% or less. The Mo content in a case where Mo is contained from the viewpoint of improving the cold forgeability is preferably 0.030% or less, and more preferably 0.020% or less.

V: 0.050% or Less

V is an element that forms a carbide, a nitride, or a carbonitride by combining with C and N. In addition, V is an element that improves hardenability of a steel even in a case where it is contained in a minute amount. Accordingly, V may be contained. In order to stably obtain these effects, the V content is preferably 0.005% or greater. In a case where the V content is greater than 0.050%, the strength of a rolled steel increases due to the precipitated carbide or nitride, and the cold forgeability is reduced. Accordingly, even in a case where V is contained, the V content is controlled to be 0.050% or less. The V content in a case where V is contained from the viewpoint of improving the cold forgeability is preferably 0.030% or less, and more preferably 0.020% or less.

Zr: 0.050% or Less

Zr is an element that acts to improve hardenability of a steel even in a case where it is contained in a minute amount. A minute amount of Zr may be contained to achieve the above object. In order to stably obtain this effect, the Zr content is preferably 0.003% or greater. In a case where the Zr content is greater than 0.050%, coarse nitrides are generated, and the cold forgeability is reduced. Accordingly, even in a case where Zr is contained, the Zr content is controlled to be 0.050% or less. The Zr content in a case where Zr is contained is preferably 0.030% or less, and more preferably 0.020% or less from the viewpoint of improving the cold forgeability.

Ca: 0.0050% or Less

Ca forms a sulfide by combining with S, and acts as a production nucleus of MnS. MnS with CaS as a production nucleus is finely dispersed and becomes a production nucleus for precipitation of ferrite during cooling after finish rolling. Accordingly, in a case where MnS dispersed finely is present, the ferrite fraction increases. That is, in a case where Ca is contained, the ferrite fraction increases, and thus Ca may be contained. In order to stably obtain this effect, the Ca content is preferably 0.0005% or greater. In a case where the Ca content is greater than 0.0050%, the effect is saturated, and Ca reacts with oxygen in the steel together with Al, and thus generates a coarse oxide. Thus, the cold forgeability is reduced. Accordingly, even in a case where Ca is contained, the Ca content is controlled to be 0.0050% or less. The Ca content in a case where Ca is contained is preferably 0.0030% or less, and more preferably 0.0020% or less from the viewpoint of improving the cold forgeability.

Mg: 0.0050% or Less

Mg is an element that forms a sulfide by combining with S, and acts as a production nucleus of MnS. Mg has an effect of finely dispersing MnS. In a case where MnS is finely dispersed, ferrite is precipitated with MnS, dispersed during cooling after finish rolling, as a production nucleus. Thus, the ferrite fraction is improved. Mg may be contained in order to obtain this effect. In order to stably obtain this effect, the Mg content is preferably 0.0005% or greater. In a case where the Mg content is greater than 0.0050%, the effect of Mg is saturated. In addition, since the adding yield of Mg is low and the adding of Mg deteriorates the manufacturing cost, the amount of Mg in a case where Mg is contained is preferably 0.0030% or less, and more preferably 0.0020% or less.

(B) Tensile Strength of Steel

The rolled bar and wire rod according to this embodiment has excellent cold forgeability. Therefore, even in a case where a spheroidizing annealing treatment after product rolling is omitted or performed in a short period of time, a reduction in the life of the die during cold forging, or cracking of the component during formation does not occur. This is because by controlling not only the chemical compositions of the steel adjusted as described above, but also the manufacturing conditions of the rolled steel, the structure of the rolled steel and the precipitates are controlled to be suitable for cold forging, and the strength of the steel is reduced. In this embodiment, excellent cold forgeability means that, for example, cracking does not occur even in a case where a round bar of φ10.5 mm×40 mmL cut out from the rolled bar and wire rod is processed into a bolt shown in FIG. 1.

In a case where the tensile strength is greater than 750 MPa, the possibility of the occurrence of cracking of the component during cold forging is increased. Therefore, in the rolled bar and wire rod according to this embodiment, it is necessary to control the tensile strength to be 750 MPa or less after controlling the structure as will be described later.

Even in a case where the tensile strength is greater than 750 MPa, cracking of the component does not easily occur during cold forging in a case where a spheroidizing annealing treatment is performed for a long period of time of approximately 20 hours or repeatedly performed more than once (for example, 10 hours×2 times). However, the rolled bar and wire rod according to this embodiment is provided to secure cold forgeability even in a case where the spheroidizing annealing treatment is omitted or the time of the spheroidizing annealing treatment is reduced such that the heat treatment is completed in at least 10 hours. In order to achieve this object, an upper of the tensile strength in the rolled bar and wire rod according to this embodiment is limited. The tensile strength of the rolled bar and wire rod is preferably 700 MPa or less, and more preferably 650 MPa or less.

(C) About Internal Structure of Steel

The rolled bar and wire rod according to this embodiment has excellent cold forgeability. Therefore, a reduction in the life of the die during cold forging, or cracking of a formed component does not occur even in a case where a conventional spheroidizing annealing treatment after product rolling requiring approximately 20 hours is omitted or performed in about half the time, or the spheroidizing annealing treatment that has been performed more than once is performed once. This is because the metallographic structure of the rolled bar and wire rod is controlled to have a form suitable for cold forging by not only adjusting the chemical compositions of the steel, but also controlling the manufacturing conditions of the rolled bar and wire rod.

Specifically, in the rolled bar and wire rod according to this embodiment, the structure (internal structure) of a portion, which excludes a surface layer portion ranging up to 100 μm from the surface in which a decarburized layer may be generated, is a ferrite-pearlite structure, and the fraction of the ferrite is 40% or greater. Here, the ferrite-pearlite structure means a structure that is a mixed structure in which ferrite and pearlite occupy 95% or greater of the entire structure in terms of an area fraction (a structure in which a total of the area fraction of the ferrite and the area fraction of the pearlite is 95% or greater). In the measurement of the ferrite fraction, a ferrite phase between lamella cementites included in the pearlite is not included as the ferrite. The mixed structure in which ferrite and pearlite occupy 95% or greater of the entire structure in terms of an area fraction means that a total of area fractions of structures such as martensite and bainite other than the ferrite and the pearlite is less than 5%. In order to obtain good cold forgeability, the mixed structure of ferrite and pearlite is required to be 95% or greater in the entire structure in terms of an area fraction, and is preferably 100%.

In the internal structure, in a case where the ferrite fraction is less than 40%, good cold forgeability cannot be secured even in a case where the tensile strength is 750 MPa or less. Thus, problems are caused such as cracking occurring in the component during formation or a reduction in the life of the die. The ferrite fraction is preferably 45% or greater, and more preferably 50% or greater. The upper limit of the ferrite fraction is not particularly specified. However, in order to control the ferrite fraction to be greater than 80% as-hot-rolled, it is necessary to spheroidize the lamella cementite that forms the pearlite structure, and for this, it is necessary to perform a soaking treatment for a long period of time after rolling. Accordingly, the cost rises, and this is difficult to industrially realize. Therefore, the upper limit of the ferrite fraction may be 80%.

In a case where the mixed structure of ferrite and pearlite is less than 95% in the entire structure in terms of an area fraction, there is a concern that the tensile strength of the rolled bar and wire rod may be greater than 750 MPa due to hard structures such as martensite and bainite. In addition, since the hard structures become fracture origins, there is a concern that the cold forgeability may be reduced.

The identification of the structures and the calculation of the area fraction are performed, for example, as follows.

A rolled bar and wire rod is cut into a length of 10 mm. Then, resin embedding is performed such that a cross-section serves as a test surface, and mirror polishing is performed. Next, the surface is corroded with a 3% nitric acid alcohol (nital etchant) to cause a microstructure to emerge. Thereafter, microstructure photographs of 5 fields of view are taken using an optical microscope at 500-fold magnification at a position corresponding to a D/4 position (D: diameter of the rolled steel) of the rolled steel bar or rolled wire rod to identify the "phase". Using image analysis software, ferrite area fractions of the respective fields of view are measured as ferrite fractions, and the average value thereof is obtained. The fraction of a total of ferrite and pearlite is obtained by obtaining a pearlite fraction in the same manner, and adding the ferrite fraction and the pearlite fraction.

(D) Preferable Manufacturing Process

In the rolled bar and wire rod according to this embodiment, it is important to control not only the chemical compositions of the steel, but also the structure as-rolled. Accordingly, rolled bar and wire rods having chemical compositions and a structure within the range of the present invention are included in the rolled bar and wire rod according to this embodiment regardless of the manufacturing methods thereof.

However, in a case where a manufacturing process including the following steps is applied to a steel having predetermined chemical compositions, a structure as-rolled can be stably controlled to be in a preferable range. Hereinafter, preferable manufacturing conditions will be described in detail.

<Steel Piece Manufacturing Step>

First, a molten steel in which chemical compositions such as C, Si, Mn, and Cr are adjusted and that is melted by a converter, a normal electric furnace, or the like is cast to obtain a steel ingot or a cast piece. The obtained steel ingot or cast piece is bloomed to obtain a steel piece (material for product rolling). At this time, a heating temperature before blooming is preferably 1200° C. or higher in order to dissolve coarse carbonitrides or carbides such as Ti(C,N), and TiC generated during solidification.

<Heating Step Prior to Rolling>

Then, the steel piece is heated prior to the rolling. In this case, the heating temperature is preferably 1050° C. or lower as long as the rolling is possible. In a case where the heating temperature is too high, the fine carbonitrides or carbides precipitated in the steel piece are dissolved and coherently precipitated along with ferrite transformation during cooling after the product rolling. Accordingly, the strength after the product rolling increases, and there is a concern that the cold forgeability may be reduced.

<Rolling Step>

After the heating, a steel bar or wire rod having a predetermined diameter is obtained by the product rolling including finish rolling. The finish rolling is rolling that is performed by a finish rolling mill array in a final step of the product rolling. In the finish rolling, a working speed Z is preferably 5 to 15/sec, and the finish rolling is preferably performed in a rolling temperature range of 750° C. to 850° C. The working speed Z is a value obtained using the following Formula (i) from a reduction of area of the steel by finish rolling and a finish rolling time. Regarding the finish rolling temperature, a temperature at an outlet side of the finish rolling mill array may be measured using an infrared radiation thermometer.

$$Z=\{-\ln(1-R)\}/t \quad \text{(i)}$$

Here, R is a reduction of area of the steel by finish rolling, and t is a finish rolling time (sec). In represents a natural logarithm.

The reduction of area R is obtained using $R=(A_0-A)/A_0$ from a cross-sectional area $A_0$ before finish rolling of the rolled bar and wire rod and a cross-sectional area A after finish rolling.

The finish rolling time t is a period of time (sec) during which the rolled bar and wire rod passes through the finish rolling mill array, and can be obtained by dividing the distance from a first rolling mill to a last rolling mill in the finish rolling mill array by the average transfer speed of the rolled bar and wire rod.

In a case where the finish rolling temperature is below 750° C. or the working speed of the finish rolling is too high, ferrite transforms from unrecrystallized austenite grains. In this case, the structure after cooling is excessively refined, and thus the strength excessively increases, and the cold forgeability is reduced. In contrast, in a case where the temperature of the finish rolling is above 850° C. or the working speed is low, austenite grains after re-crystallization become coarse, and a ferrite transformation start temperature is lowered. In this case, the ferrite fraction of the structure after cooling is reduced, and the cold forgeability is reduced.

<Cooling Step>

After the finish rolling is completed, cooling is preferably performed at an average cooling rate of 0.2 to 5° C./sec until the surface temperature of the rolled steel goes down to 500° C.

In a case where the average cooling rate to 500° C. is lower than 0.2° C./sec, a time of transformation from austenite to ferrite is long, and thus there is a concern that decarburization may occur in the surface layer portion of the rolled steel. In a case where the average cooling rate is higher than 5° C./sec, there is a concern that hard structures such as martensite and bainite may be formed.

With a manufacturing process including the above-described manufacturing steps, it is possible to stably obtain a rolled bar and wire rod having such a tensile strength and internal structure that hardenability for obtaining quenched hardness at a level suitable for use in a high-strength cold-forged component is secured, and good cold forgeability can be realized even in a case where a spheroidizing annealing treatment is omitted or the time of the spheroidizing annealing treatment is reduced.

By performing cold forging, quenching, and tempering on the rolled steel bar or wire rod according to this embodiment, a high-strength cold-forged component can be obtained.

Examples

Hereinafter, the present invention will be described in detail using examples, but is not limited to these examples.

Even in a case where steels have the same chemical compositions, structures thereof vary according to the manufacturing process. Accordingly, the requirements of the present invention may not be satisfied even in a case where the chemical compositions of the present invention are satisfied. Therefore, first, structures and characteristics of steels, obtained by manufacturing steels having the same chemical compositions under different manufacturing conditions, were evaluated. Next, steel ingots having different chemical compositions were melted, and rolled steels were manufactured under the same conditions to evaluate structures and characteristics of the obtained steels.

Specifically, first, steels having chemical compositions shown in Table 1 were melted by an electric furnace, and the obtained steel ingots were heated at 1200° C. and bloomed into steel pieces with 162 mm square. In the steels having the chemical compositions shown in Table 1, A0, A1, and A2 have the same chemical compositions, and B0, B1, and B2 have the same chemical compositions. In Table 1, the symbol "-" represents that the element content is at an impurity level, and the element can be judged to be not substantially contained.

Regarding these steels, manufacturing conditions of the steps until the product rolling with respect to the steel piece after blooming to a wire rod having a predetermined diameter were changed to obtain steel bars or wire rods.

That is, in Invention Examples A0 and B0 shown in Table 1, steel pieces with 162 mm square were used as materials for product rolling. These steel pieces were heated at 1040° C., and then subjected to product rolling at a finish rolling temperature of 820° C. so as to obtain a predetermined diameter, and thus a rolled steel bar or rolled wire rod were produced. In this case, the working speed of the finish rolling was in a range of 5 to 15/sec, and after the finish rolling was completed, cooling was performed in such a way that the average cooling rate to 500° C. was 0.4° C./sec.

In Invention Examples A01 and B01 shown in Table 1, steel pieces with 162 mm square were used as materials for product rolling. These steel pieces were heated at 1040° C., and then subjected to product rolling at a finish rolling temperature of 850° C. so as to obtain a predetermined diameter, and thus a rolled steel bar or rolled wire rod were produced. In this case, the working speed of the finish rolling was in a range of 5 to 15/sec, and after the finish rolling was completed, cooling was performed in such a way that the average cooling rate to 500° C. was 0.4° C./sec.

In Comparative Examples A1, A2, B1 and B2, steel pieces with 162 mm square were used as materials for product rolling, and a heating temperature and finish rolling temperature were changed shown in table 1, and thus a rolled steel were produced. Other conditions were the same as those of A0 and B0.

Specifically, in Comparative Examples A1 and B1, steel pieces were heated at 1050° C. prior to product rolling, and then subjected to product rolling at a finish rolling temperature of 920 to 950° C. so as to obtain a predetermined diameter, and thus a rolled steel bar or rolled wire rod were produced. In this case, the working speed of the finish rolling was in a range of 5 to 15/sec, and after the finish rolling was completed, cooling was performed in such a way that the average cooling rate to 500° C. was 0.4° C./sec.

In addition, in Comparative Examples A2 and B2, steel pieces were heated at 1150° C. prior to product rolling, and then subjected to product rolling at a finish rolling temperature of 830° C. so as to obtain a predetermined diameter, and thus a rolled steel bar or rolled wire rod were produced. In this case, the working speed of the finish rolling was in a range of 5 to 15/sec, and after the finish rolling was completed, cooling was performed in such a way that the average cooling rate to 500° C. was 0.4° C./sec.

Next, rolled steels were produced from steel pieces having chemical compositions shown in No. 1 to 25 in Table 2, using the following method. In Table 2, the symbol "-" represents that the element content is at an impurity level, and the element can be judged to be not substantially contained.

That is, steels having chemical compositions shown in Table 2 were melted by an electric furnace, and the obtained steel ingots were heated at 1200° C. and bloomed into steel pieces with 162 mm square. These steel pieces were used as materials for product rolling. Next, the materials for product rolling were heated at 1030° C. to 1050° C., and then subjected to product rolling at a finish rolling temperature adjusted to be between 750° C. to 850° C. In this case, the working speed of the finish rolling was in a range of 5 to 15/sec in all of the cases, and after the finish rolling was completed, cooling was performed in such a way that the average cooling rate to 500° C. was 0.4 to 2° C./sec.

TABLE 1 mass %: remainder of Fe and impurities

| Steel No. | | C | Si | Mn | P | S | Cr | Al | Ti | N | B |
|---|---|---|---|---|---|---|---|---|---|---|---|
| Invention | A0 | 0.32 | 0.03 | 0.38 | 0.009 | 0.010 | 1.10 | 0.030 | 0.036 | 0.0038 | 0.0023 |
| Examples | A01 | 0.32 | 0.03 | 0.38 | 0.009 | 0.010 | 1.10 | 0.030 | 0.036 | 0.0038 | 0.0023 |
| Comparative | A1 | 0.32 | 0.03 | 0.38 | 0.009 | 0.010 | 1.10 | 0.030 | 0.036 | 0.0038 | 0.0023 |
| Examples | A2 | 0.32 | 0.03 | 0.38 | 0.009 | 0.010 | 1.10 | 0.030 | 0.036 | 0.0038 | 0.0023 |
| Invention | B0 | 0.30 | 0.04 | 0.42 | 0.008 | 0.010 | 1.05 | 0.039 | 0.039 | 0.0046 | 0.0020 |
| Examples | B01 | 0.30 | 0.04 | 0.42 | 0.008 | 0.010 | 1.05 | 0.039 | 0.039 | 0.0046 | 0.0020 |
| Comparative | B1 | 0.30 | 0.04 | 0.42 | 0.008 | 0.010 | 1.05 | 0.039 | 0.039 | 0.0046 | 0.0020 |
| Examples | B2 | 0.30 | 0.04 | 0.42 | 0.008 | 0.010 | 1.05 | 0.039 | 0.039 | 0.0046 | 0.0020 |

| Steel No. | | Cu | Ni | Mo | V | Ca | Mg | Zr | Heating Temperature of Product Rolling | Finish Rolling Temperature |
|---|---|---|---|---|---|---|---|---|---|---|
| Invention | A0 | — | — | — | — | — | — | — | 1040° C. | 820° C. |
| Examples | A01 | — | — | — | — | — | — | — | 1040° C. | 850° C. |
| Comparative | A1 | — | — | — | — | — | — | — | 1050° C. | 950° C. |
| Examples | A2 | — | — | — | — | — | — | — | 1150° C. | 830° C. |
| Invention | B0 | 0.08 | 0.07 | — | — | — | — | — | 1040° C. | 820° C. |
| Examples | B01 | 0.08 | 0.07 | — | — | — | — | — | 1040° C. | 850° C. |
| Comparative | B1 | 0.08 | 0.07 | — | — | — | — | — | 1050° C. | 920° C. |
| Examples | B2 | 0.08 | 0.07 | — | — | — | — | — | 1150° C. | 830° C. |

TABLE 2 mass %: remainder of Fe and impurities

| | Steel No. | C | Si | Mn | P | S | Cr | Al | Ti | N | B | Cu | Ni | Mo | V | Ca | Mg | Zr |
|---|---|---|---|---|---|---|---|---|---|---|---|---|---|---|---|---|---|---|
| Invention Examples | 1 | 0.30 | 0.06 | 0.30 | 0.010 | 0.006 | 0.98 | 0.042 | 0.034 | 0.0035 | 0.0016 | — | — | — | — | — | — | — |
| | 1' | 0.29 | 0.06 | 0.29 | 0.009 | 0.005 | 1.02 | 0.035 | 0.036 | 0.0041 | 0.0021 | — | — | — | — | — | — | — |
| | 2 | 0.29 | 0.05 | 0.39 | 0.009 | 0.007 | 1.00 | 0.038 | 0.039 | 0.0046 | 0.0019 | — | — | — | — | — | — | — |
| | 3 | 0.35 | 0.06 | 0.32 | 0.012 | 0.009 | 1.25 | 0.035 | 0.038 | 0.0046 | 0.0017 | — | — | — | — | — | — | — |
| | 4 | 0.32 | 0.05 | 0.44 | 0.010 | 0.005 | 0.97 | 0.034 | 0.035 | 0.0041 | 0.0022 | — | — | — | — | — | — | — |
| | 5 | 0.29 | 0.06 | 0.34 | 0.009 | 0.013 | 1.39 | 0.039 | 0.039 | 0.0055 | 0.0029 | — | — | — | — | — | — | — |
| | 6 | 0.28 | 0.22 | 0.38 | 0.008 | 0.006 | 0.85 | 0.041 | 0.038 | 0.0040 | 0.0024 | — | — | — | — | — | — | — |
| | 7 | 0.26 | 0.35 | 0.27 | 0.007 | 0.005 | 1.15 | 0.035 | 0.044 | 0.0064 | 0.0031 | — | — | — | — | — | — | — |
| | 8 | 0.31 | 0.07 | 0.31 | 0.010 | 0.010 | 1.05 | 0.036 | 0.035 | 0.0043 | 0.0024 | 0.10 | — | — | — | — | — | — |
| | 9 | 0.30 | 0.04 | 0.30 | 0.011 | 0.006 | 1.09 | 0.040 | 0.031 | 0.0045 | 0.0016 | 0.09 | 0.08 | — | — | — | — | — |
| | 10 | 0.28 | 0.04 | 0.29 | 0.007 | 0.009 | 1.00 | 0.045 | 0.024 | 0.0031 | 0.0013 | — | — | — | 0.015 | — | — | — |
| | 11 | 0.27 | 0.06 | 0.28 | 0.012 | 0.010 | 0.95 | 0.033 | 0.036 | 0.0039 | 0.0009 | — | — | 0.010 | — | — | — | — |
| | 12 | 0.26 | 0.07 | 0.32 | 0.007 | 0.009 | 0.98 | 0.030 | 0.031 | 0.0041 | 0.0016 | — | — | — | — | 0.0013 | — | — |
| | 13 | 0.27 | 0.05 | 0.35 | 0.008 | 0.008 | 0.99 | 0.027 | 0.052 | 0.0069 | 0.0018 | — | — | — | — | — | 0.0005 | 0.016 |
| Comparative Examples | 14 | 0.27 | 0.04 | 0.27 | 0.009 | 0.006 | 0.88 | 0.035 | 0.036 | 0.0040 | 0.0018 | — | — | — | — | — | — | — |
| | 15 | 0.26 | 0.07 | 0.29 | 0.010 | 0.007 | 0.77 | 0.028 | 0.032 | 0.0045 | 0.0021 | — | — | — | — | — | — | — |
| | 16 | 0.22 | 0.05 | 0.30 | 0.007 | 0.010 | 0.95 | 0.033 | 0.033 | 0.0046 | 0.0017 | — | — | — | — | — | — | — |
| | 17 | 0.40 | 0.05 | 0.40 | 0.010 | 0.011 | 1.05 | 0.038 | 0.039 | 0.0048 | 0.0019 | — | — | — | — | — | — | — |
| | 18 | 0.32 | 0.04 | 0.82 | 0.014 | 0.008 | 0.99 | 0.034 | 0.032 | 0.0046 | 0.0015 | — | — | — | — | — | — | — |
| | 19 | 0.33 | 0.08 | 0.40 | 0.010 | 0.033 | 1.00 | 0.038 | 0.039 | 0.0050 | 0.0019 | — | — | — | — | — | — | — |
| | 20 | 0.28 | 0.05 | 0.33 | 0.012 | 0.009 | 0.55 | 0.028 | 0.035 | 0.0049 | 0.0017 | — | — | — | — | — | — | — |
| | 21 | 0.30 | 0.20 | 0.39 | 0.009 | 0.010 | 1.25 | 0.030 | 0.075 | 0.0037 | 0.0022 | — | 0.05 | — | — | — | — | — |
| | 22 | 0.34 | 0.05 | 0.42 | 0.008 | 0.007 | 1.22 | 0.025 | 0.015 | 0.0032 | 0.0025 | — | — | — | — | — | — | — |
| | 23 | 0.28 | 0.06 | 0.38 | 0.012 | 0.010 | 0.90 | 0.030 | 0.030 | 0.0044 | 0.0002 | 0.05 | — | — | — | — | — | — |
| | 24 | 0.32 | 0.06 | 0.40 | 0.012 | 0.010 | 1.50 | 0.031 | 0.035 | 0.0036 | 0.0024 | 0.05 | 0.05 | — | — | — | — | — |
| | 25 | 0.30 | 0.05 | 0.34 | 0.010 | 0.011 | 1.05 | 0.032 | 0.036 | 0.0038 | 0.0021 | — | — | — | 0.10 | — | — | — |

With respect to the rolled steel bars or rolled wire rods produced by the above-described method, diameter, tensile strength, ferrite fraction, the sum of a ferrite fraction and a pearlite fraction, hardness after quenched, hardness after quenching and tempering, cold forgeability were investigated.

The results are shown in Table 3 and Table 4.

Tensile strength, ferrite fraction, hardness after quenching and tempering, cold forgeability of rolled steel were investigated by the following method.

<1> Investigation of Tensile Strength of Rolled Steel Bar or Rolled Wire Rod:

A 14A-test piece (diameter of parallel portion: 6 mm) specified in JIS Z 2241 was collected from a position of a center of the rolled steel bar or rolled wire rod such that a longitudinal direction of the test piece was a rolling direction of the steel. The gage length was set to 30 mm and a tensile test was performed at room temperature to obtain the tensile strength.

<2> Investigation of Ferrite Fraction and Pearlite Fraction of Rolled Steel:

The rolled steel bar or rolled wire rod was cut into a length of 10 mm. Then, resin embedding was performed such that a cross-section served as a test surface, and mirror polishing was performed. Next, the surface was corroded with a 3% nitric acid alcohol (nital etchant) to cause a microstructure to emerge. Thereafter, microstructure photographs of 5 fields of view were taken using an optical microscope at 500-fold magnification at a position corresponding to a D/4 position (D: diameter of the rolled steel) of the rolled steel bar or rolled wire rod to identify the "phase". Using image analysis software, ferrite area fractions of the respective fields of view were measured as ferrite fractions, and the average value thereof was obtained. In addition, a pearlite fraction was obtained in the same manner to obtain a total of the ferrite fraction and the pearlite fraction.

<3> Investigation of Quenched hardness

The rolled steel bar or rolled wire rod was cut into a length of 200 mmL, and then heated at 880° C. for 60 minutes in an Ar gas atmosphere and dipped in an oil tank at 60° C. to be quenched. Next, a test piece with a length of 10 mm was collected from a position of a center in a longitudinal direction of the quenched round bar, and then polishing was performed on a cross-section as a test surface to measure HRC hardness in a center portion of the cross-section.

<4> Investigation of Tempered Hardness

The rest of the round bar quenched by the above-described method was subjected to tempering in such a way that it was heated at 425° C. for 60 minutes in the atmosphere, and then taken out from the furnace to be cooled (air cooling in the atmosphere). A test piece with a length of 10 mm was collected from a position of a center of the round bar after the tempering, and then polishing was performed on a cross-section as a test surface to measure HRC hardness in a center portion of the cross-section.

<5> Investigation of Cold Forgeability

The cold forgeability was evaluated after actually performing cold forging on a bolt using the obtained rolled steel bar or rolled wire rod.

Specifically, a round bar of φ10.5 mm×40 mmL was cut out through mechanical working from a position corresponding to a center portion of the cross section of the rolled steel bar or rolled wire rod. Next, degreasing and pickling were performed, and then a zinc phosphate treatment (75° C., dipping time: 600 seconds) and a metallic soap treatment (80° C., dipping time: 180 seconds) were performed to attach a lubrication-treated film including a zinc phosphate film and a metallic soap film to the surface. The resulting material was used as a material for bolt forging. For bolt forging, a die was designed such that working including: a first step of press-forming a shaft portion by forging; and a second step of forming a bolt head portion and a flange portion could be performed such that forging into a shape shown in FIG. 1 was possible, and this die was mounted on a hydraulic forging press to perform cold forging. In FIG. 1, the unit of numerical values is mm.

Regarding the cold forgeability, whether cracking occurred in a surface of the bolt during bolt formation was visually determined. The cold forgeability was evaluated in such a way that a case where cracking occurred in the surface of the bolt was evaluated as NG, and a case where cracking did not occur in any part was evaluated as OK. The cracking in the surface of the bolt mainly occurred at a tip end of a flange portion of a bolt head portion.

TABLE 3

| | Steel No. | Diameter (mm) | Y1 | Y2 | Tensile Strength (MPa) | Ferrite Fraction (%) | Ferrite + Pearlite Area Fraction (%) | Quenched Hardness (HRC) | Tempered Hardness (HRC) | Cold Forgeability |
|---|---|---|---|---|---|---|---|---|---|---|
| Invention | A0 | 15.0 | 0.418 | 0.146 | 615 | 48 | 100 | 49 | 41 | OK |
| Examples | A01 | 15.0 | 0.418 | 0.146 | 625 | 45 | 96 | 49 | 41 | OK |
| Comparative | A1 | 15.0 | 0.418 | 0.146 | 775 | 36 | 70 | 49 | 41 | NG |
| Examples | A2 | 15.0 | 0.418 | 0.146 | 792 | 41 | 90 | 49 | 41 | NG |
| Invention | B0 | 15.0 | 0.441 | 0.155 | 598 | 50 | 100 | 48 | 40 | OK |
| Examples | B01 | 15.0 | 0.441 | 0.155 | 601 | 48 | 97 | 48 | 40 | OK |
| Comparative | B1 | 15.0 | 0.441 | 0.155 | 764 | 35 | 70 | 48 | 40 | NG |
| Examples | B2 | 15.0 | 0.441 | 0.155 | 779 | 42 | 90 | 48 | 40 | NG |

TABLE 4

| | Steel No. | Diameter (mm) | Y1 | Y2 | Tensile Strength (MPa) | Ferrite Fraction (%) | Ferrite + Pearlite Area Fraction (%) | Quenched Hardness (HRC) | Tempered Hardness (HRC) | Cold Forgeability |
|---|---|---|---|---|---|---|---|---|---|---|
| Invention | 1 | 12.0 | 0.294 | 0.097 | 585 | 51 | 100 | 47 | 38 | OK |
| Examples | 1' | 12.0 | 0.296 | 0.101 | 591 | 48 | 96 | 46 | 38 | OK |
| | 2 | 15.0 | 0.390 | 0.160 | 579 | 52 | 100 | 46 | 37 | OK |
| | 3 | 20.0 | 0.400 | 0.223 | 645 | 46 | 100 | 51 | 42 | OK |
| | 4 | 20.0 | 0.427 | 0.239 | 645 | 41 | 100 | 49 | 41 | OK |
| | 5 | 25.0 | 0.473 | 0.356 | 616 | 50 | 100 | 48 | 41 | OK |
| | 6 | 15.0 | 0.323 | 0.165 | 604 | 49 | 100 | 46 | 39 | OK |
| | 7 | 15.0 | 0.311 | 0.176 | 582 | 52 | 100 | 45 | 38 | OK |
| | 8 | 15.0 | 0.326 | 0.150 | 592 | 50 | 100 | 49 | 40 | OK |
| | 9 | 15.0 | 0.327 | 0.155 | 616 | 48 | 100 | 48 | 40 | OK |
| | 10 | 15.0 | 0.290 | 0.165 | 576 | 52 | 100 | 47 | 40 | OK |
| | 11 | 15.0 | 0.266 | 0.171 | 555 | 55 | 100 | 46 | 40 | OK |

TABLE 4-continued

| | Steel No. | Diameter (mm) | Y1 | Y2 | Tensile Strength (MPa) | Ferrite Fraction (%) | Ferrite + Pearlite Area Fraction (%) | Quenched Hardness (HRC) | Tempered Hardness (HRC) | Cold Forgeability |
|---|---|---|---|---|---|---|---|---|---|---|
| | 12 | 15.0 | 0.314 | 0.176 | 542 | 57 | 100 | 45 | 36 | OK |
| | 13 | 15.0 | 0.347 | 0.171 | 565 | 56 | 100 | 46 | 37 | OK |
| Comparative | 14 | 20.0 | 0.238 | 0.272 | 556 | 54 | 100 | 35 | 26 | OK |
| Examples | 15 | 20.0 | 0.223 | 0.280 | 532 | 57 | 100 | 33 | 24 | OK |
| | 16 | 15.0 | 0.285 | 0.203 | 503 | 61 | 100 | 38 | 29 | OK |
| | 17 | 15.0 | 0.420 | 0.116 | 778 | 33 | 70 | 55 | 46 | NG |
| | 18 | 15.0 | 0.812 | 0.146 | 790 | 35 | 70 | 49 | 40 | NG |
| | 19 | 15.0 | 0.400 | 0.142 | 640 | 46 | 100 | 48 | 39 | NG |
| | 20 | 15.0 | 0.182 | 0.165 | 522 | 57 | 100 | 37 | 28 | OK |
| | 21 | 15.0 | 0.488 | 0.155 | 799 | 43 | 90 | 49 | 41 | NG |
| | 22 | 15.0 | 0.512 | 0.137 | 766 | 34 | 85 | 46 | 37 | NG |
| | 23 | 15.0 | 0.342 | 0.165 | 535 | 54 | 100 | 36 | 26 | OK |
| | 24 | 15.0 | 0.600 | 0.146 | 815 | 30 | 50 | 48 | 41 | NG |
| | 25 | 15.0 | 0.357 | 0.155 | 835 | 49 | 85 | 49 | 42 | NG |

From Table 3, in all of Test Nos. A0, A01, B0 and B01, that were the invention examples, the chemical compositions and the above-described Formulas <1> to <3> were satisfied, and the steel manufacturing conditions were appropriate. Thus, the tensile strength was 750 MPa or less, and a ferrite-pearlite structure having a ferrite fraction of 40% or greater was obtained. In addition, the quenched hardness was 45 or greater in terms of HRC hardness and hardness after quenching and tempering was 34 or greater in terms of HRC hardness. In addition, there were no problems in cold forgeability. As a result, the cold forgeability does not reach the target.

On the other hand, in Test Nos. A1, A2, B1 and B2, the tensile strength or the ferrite fraction did not reach targets thereof.

Test No. A1 has the same chemical compositions as Test No. A0. However, since the finish rolling temperature was high, that is, 950° C., the tensile strength is 750 MPa or greater, and the ferrite fraction is 40% or less. As a result, the cold forgeability is poor.

Test No. A2 has the same chemical compositions as Test No. A0. However, since the heating temperature of product rolling was high, that is, 1150° C., the tensile strength is 750 MPa or greater, and as a result, the cold forgeability is poor.

Test No. B1 has the same chemical compositions as Test No. B0. However, since the finish rolling temperature is high, that is, 920° C., the tensile strength is 750 MPa or greater, and the ferrite fraction is 40% or less. Thus, the cold forgeability is poor.

Test No. B2 has the same chemical compositions as Test No. B0. However, since the heating temperature of product rolling was high, that is, 1150° C., the tensile strength is 750 MPa or greater. As a result, the cold forgeability is poor.

In addition, from Table 4, in all of the rolled steel bars or rolled wire rods of Test Nos. 1 to 13, that were the invention examples, since the chemical compositions and the above-described Formulas <1> to <3> were satisfied, the tensile strength was 750 MPa or less, and a ferrite fraction was 40% or greater. In addition, the quenched hardness of the center portion of the steel was 45 or greater in terms of HRC hardness, and there were no problems in cold forgeability.

On the other hand, in the rolled steel bars or rolled wire rods of Test Nos. 14 to 25, since any one of the chemical compositions, or values of Y1 and Y2 shown in the above-described Formulas <1> and <2> did not satisfy the regulations of the present invention, any one or more of the quenched hardness of the center portion of the steel, the cold forgeability did not reach targets thereof.

In Test Nos. 14 and 15, the chemical compositions satisfy the specified ranges of the present invention, but the value of Y1 is Y2 or less. Accordingly, the quenched hardness of the center portion of the steel is less than 45 in terms of HRC, and the hardenability is not sufficient. As a result, the hardness after quenching and tempering is less than 34 in terms of HRC.

In Test No. 16, since the C content is lower than the specified range of the present invention, the quenched hardness of the center portion of the steel is less than 45 in terms of HRC, and the quenched hardness is not sufficient. As a result, the hardness after quenching and tempering is less than 34 in terms of HRC.

In Test No. 17, the C content is higher than the specified range of the present invention, the tensile strength is 750 MPa or greater, and the ferrite fraction is 40% or less. Accordingly, the cold forgeability is poor.

In Test No. 18, the Mn content is higher than the specified range of the present invention, and a ferrite transformation start temperature is reduced. Accordingly, the tensile strength is 750 MPa or greater, and the ferrite fraction is 40% or less, and the cold forgeability is poor.

In Test No. 19, the tensile strength is 750 MPa or less, and the ferrite fraction is 40% or greater. However, the S content is higher than the specified range of the present invention, and thus MnS is coarse, and the cold forgeability is poor.

In Test No. 20, the Cr content is lower than the specified range of the present invention, the quenched hardness of the center portion of the steel is less than 45 in terms of HRC, and the hardenability is not sufficient. As a result, the hardness after quenching and tempering is less than 34 in terms of HRC.

In Test No. 21, the Ti content is higher than the specified range of the present invention, the tensile strength is 750 MPa or greater, and the cold forgeability is poor.

In Test No. 22, the Ti content is lower than the specified range of the present invention, the tensile strength is 750 MPa or greater, the ferrite fraction is 40% or less, and the cold forgeability is poor.

In Test No. 23, the B content is lower than the specified range of the present invention, the quenched hardness of the center portion of the steel is less than 45 in terms of HRC, and the hardenability is not sufficient. As a result, the hardness after quenching and tempering is less than 34 in terms of HRC.

In Test No., the Cr content is higher than the specified range of the present invention, and bainite is generated in ratio of 50%. Accordingly, the tensile strength is 750 MPa or greater, the ferrite fraction is less than 40%, and the cold forgeability is poor.

In Test No. 25, the V content is higher than the specified range of the present invention. Since V precipitates as a fine carbonitride or carbide, although the ferrite fraction is 40% or greater, the tensile strength is 750 MPa or greater, and the cold forgeability is poor.

INDUSTRIAL APPLICABILITY

Using a rolled bar and wire rod for a high-strength cold-forged component of the present invention as a material, it is possible to obtain a high-strength cold-forged component having excellent hardenability, in which formation can be performed by cold forging even in a case where a spheroidizing annealing treatment is omitted or the time of the spheroidizing annealing treatment is reduced.

BRIEF DESCRIPTION OF THE REFERENCE SYMBOLS

B: BORDER LINE

What is claimed is:

1. A rolled steel bar or rolled wire rod for a cold-forged component that has a chemical composition consisting of, in mass %:

C: 0.24% to 0.36%;
Si: less than 0.40%;
Mn: 0.20% to 0.45%;
S: less than 0.020%;
P: less than 0.020%;
Cr: 0.70% to 1.45%;
Al: 0.005% to 0.060%;
Ti: greater than 0.020% to 0.060%;
B: 0.0003% to 0.0040%;
N: 0.0020% to 0.0080%;
Cu: 0% to 0.50%;
Ni: 0% to 0.30%;
Mo: 0% to 0.050%;
V: 0% to 0.050%;
Zr: 0% to 0.050%;
Ca: 0% to 0.0050%; and
Mg: 0% to 0.0050% with a remainder of Fe and impurities, wherein Y1 and Y2 represented by the following Formulas <1> and <2>, satisfy a relationship represented by the following Formula <3>, a tensile strength is 750 MPa or less, an internal structure defined as a region from a center to a surface layer portion, wherein the internal structure consists of ferrite, pearlite and impurities, wherein the surface layer portion ranges up to 100 um from the surface, and a ferrite fraction is 40% or greater in the internal structure $$Y1=[Mn]\times[Cr] \quad \text{Formula <1>,}$$

$$Y2=0.134\times(D/25.4-(0.50\times\sqrt{[C]}))/(0.50\times\sqrt{[C]}) \quad \text{Formula <1>,}$$

$$Y1>Y2 \quad \text{Formula <3>,}$$

where [C], [Mn], and [Cr] in the formulas represent respective amounts of elements in mass %, and D represents a diameter of the rolled steel bar or rolled wire rod in the unit of mm.

2. The rolled steel bar or rolled wire rod for a cold-forged component according to claim 1, wherein the chemical composition contains, in mass %, one or more selected from the group consisting of Cu: 0.03% to 0.50%,
Ni: 0.01% to 0.30%,
Mo: 0.005% to 0.050%, and
V: 0.005% to 0.050%.

3. The rolled steel bar or rolled wire rod for a cold-forged component according to claim 1, wherein the chemical composition contains, in mass %, one or more selected from the group consisting of Zr: 0.003% to 0.050%,
Ca: 0.0005% to 0.0050%, and
Mg: 0.0005% to 0.0050%.

4. The rolled steel bar or rolled wire rod for a cold-forged component according to claim 2, wherein the chemical composition contains, in mass %, one or more selected from the group consisting of Zr: 0.003% to 0.050%,
Ca: 0.0005% to 0.0050%, and
Mg: 0.0005% to 0.0050%.

5. The rolled steel bar or rolled wire rod for a cold-forged component according to claim 1, wherein the chemical composition contains, in mass %,
Mn: 0.20% to 0.30%.

* * * * *